United States Patent [19]

Volk, Jr. et al.

[11] 4,437,852

[45] Mar. 20, 1984

[54] METHOD OF PRODUCING MAILER WITH SELF CONTAINED REPLY ENVELOPE

[75] Inventors: Kurt E. Volk, Jr., Westport; Everett H. Herbert, Fairfield; John W. Stenner, Orange, all of Conn.

[73] Assignee: Kurt H. Volk, Inc., Milford, Conn.

[21] Appl. No.: 330,320

[22] Filed: Dec. 14, 1981

[51] Int. Cl.[3] ..... B31B 49/04

[52] U.S. Cl. ..... 493/216; 493/921

[58] Field of Search ..... 493/216, 921; 53/460, 53/206, 266 A

[56] References Cited

U.S. PATENT DOCUMENTS

| | | | |
|---|---|---|---|
| 3,557,519 | 1/1971 | Lyon, Jr. | 493/216 X |
| 3,579,947 | 5/1971 | Kalman | 493/216 X |
| 4,063,398 | 12/1977 | Huffman | 493/216 X |
| 4,067,171 | 1/1978 | Herbert et al. | 493/216 X |
| 4,161,091 | 7/1979 | Hartnig | 493/921 X |

FOREIGN PATENT DOCUMENTS

| | | | |
|---|---|---|---|
| 572222 | 3/1959 | Canada | 493/216 |

*Primary Examiner*—James F. Coan

*Attorney, Agent, or Firm*—Thomas E. Spath

[57] ABSTRACT

Methods for manufacturing articles suitable for mailing, comprising an outer envelope containing at least one enclosure and a pre-formed return envelope, wherein the outer envelope, enclosure and pre-formed reply envelope are prepared from one or more integral sheets.

19 Claims, 15 Drawing Figures

METHOD OF PRODUCING MAILER WITH SELF CONTAINED REPLY ENVELOPE

BACKGROUND OF THE INVENTION

1. Field of the Invention

This invention relates to the manufacture of articles suitable for mailing comprising an outer envelope containing at least one pre-printed enclosure and a preformed return envelope, one or more of which can be personalized.

2. Description of the Prior Art

The method described herein is particularly suited for commercial production of articles such as advertisements, solicitations, billings and the like, in which the printed contents is for the most part the same, and tens of thousands, or even millions of articles must be mailed. Such mailings often include a return envelope to encourage a favorable and prompt reply.

Large volume mailings of this type are often "personalized." A mailed article is personalized when information more or less unique to the intended recipient is printed on the article and/or on its enclosures. The information that can be personalized includes the recipient's name, address, sex, age, account or billing number, and other data. The information can be represented by either alpha-numeric characters or indicia particularly adapted to be read by electronic character recognition devices, such as bar codes and the like.

This invention is a further improvement over the method previously disclosed and claimed in U.S. Pat. No. 4,067,171, issued Jan. 10, 1978. That patent describes a method for preparing an envelope containing a plurality of enclosure sheets. Also pertinent is the disclosure of U.S. Pat. No. 3,557,519 issued Jan. 29, 1971, which describes a method for making, from an envelope sheet integral with a letter sheet, an addressed envelope containing a single personalized letter. The methods disclosed in both these patents permit large volume mailings of personalized articles while eliminating the possibility of mismatching.

The teachings and disclosures of both U.S. Pat. Nos. 3,557,519 and 4,067,171 are incorporated herein by reference. In the practice of the inventions claimed in the above patents, as well as other methods known to the prior art for preparing mailers, if a reply envelope was to be enclosed in the mailer it was necessary to insert the reply envelope into the outer envelope as a separate step before sealing. The reply envelope could only be personalized at the risk of mismatching the personalized information printed on the reply envelope with the other items mailed.

SUMMARY OF THE INVENTION

The present invention relates to a method for producing an article suitable for mailing, comprising an outer envelope containing at least one enclosure and a separate reply envelope formed during manufacture of the article, rather than being inserted subsequently. The method produces a preformed and completely made-up reply envelope simultaneously with the preparation of the outer envelope and enclosures. The flap of the reply envelope can be provided with remoistenable gum and, in a preferred embodiment, a response device is detachably connected to the flap along a line of perforations. Personalization can be provided on the outer envelope, the enclosure or letter sheets, and on the reply envelope and response device. The invention allows a variety of enclosures to be formed in the manufacture of the article.

The present invention comprises a number of steps. In practicing one method of the present invention, the first step is to mate in a superposed, aligned configuration a first composite sheet with a second composite sheet. The first composite sheet consists of an outer envelope sheet defining a flap, a front panel and a rear panel, and integral therewith a first enclosure sheet joined along a transverse line to the rear panel. The second composite sheet consists of a second enclosure sheet, and integral therewith a reply envelope sheet defining a flap, a front panel and a rear panel, the reply envelope sheet being joined along a transverse line to the second enclosure sheet. In a preferred embodiment of the present invention, a response device is positioned between the second enclosure sheet and the reply envelope sheet, one transverse line or perforations joining the response device to the second enclosure sheet, and another transverse line of perforations joining the reply envelope sheet to the response device.

After mating, the composite sheets are folded so as to superpose the reply envelope rear panel in alignment with the reply envelope front panel. The longitudinal edges of the front and rear reply envelope panels then are bonded to form a reply envelope pocket. In the next step, the composite sheets are further folded to position the reply envelope, first enclosure sheet, second enclosure sheet, and optionally, the response device, between the front and rear panels of the outer envelope sheet. The longitudinal edges of the outer envelope front and rear panels are next bonded to form an outer envelope pocket containing the reply envelope, the first and second enclosure sheets, and, optionally, the response device. Finally, while the outer envelope flap remains open, a separating step simultaneously separates the first enclosure sheet from the outer envelope rear panel, and the second enclosure sheet from the reply envelope, or, if used, from the response device. Following the method described, the resulting article comprises an outer envelope containing a separate first and second enclosure sheet, a separate reply envelope, and optionally, a response device detachably joined to the reply envelope.

In another embodiment of the present invention, the method can be adapted to provide additional separate enclosure sheets with the outer envelope. It is also possible to eliminate enclosure sheets entirely, the only enclosure then being a response device along with the reply envelope.

The method described is particularly advantageous for preparing large numbers of enclosures and reply envelopes, each of which is imprinted with one or more personalized messages. The method described herein substantially eliminates the mismatching of the personalized enclosures and reply envelope.

The use of personalized enclosures in connection with commercial solicitations is believed to improve the likelihood of obtaining a favorable response from the recipient. The method described herein further improves the likelihood of obtaining a favorable response, because the recipient need not spend the time to enter his return address on the enclosed reply envelope.

A personalized reply envelope is particularly advantageous for use in periodic billing. It is not uncommon for organizations that perform periodic billing to request customers to write their billing or account number on the reply envelope. It is also not uncommon for such customers to fail to do so. Consequently, having the customer or account number already entered on the reply envelope greatly improves record keeping. Efficiency results, since the customer or account number will be printed in a uniform, clear manner which can be machine readable. It also eliminates the problem which arises when a customer encloses a check but neglects to return the statement, paper or card containing information identifying him. Because the reply envelope can contain personalized information, identification is assured.

Production of an article by the method described herein allows information to be gathered that was previously unavailable. Because the personalized information printed on the reply envelope is of a uniform character, it is possible to read such information with presently available optical character readers and like equipment. Thus, upon receipt of the reply envelope, the transmitting organization can instantly record the fact that a particular recipient has replied. This is particularly important to organizations such as book clubs, which periodically send items to subscribers or customers who reply only when they do not desire the item, or desire a different item. Accordingly, no unwanted item will be inadvertently sent because of the inevitable time lag between receipt of the reply envelope and examination of its contents.

The methods described herein can be readily adapted to produce articles in a variety of sizes and formats which are within the capabilities of commercial lithographic and computer directed printers, and the folding and converting equipment which is available in the art.

Additional specific uses and advantages of the various formats which can be embodied in the methods of the invention herein will be apparent to those familiar with the art in view of the teachings of this specification.

DESCRIPTION OF THE PREFERRED EMBODIMENTS

Figure 1A:
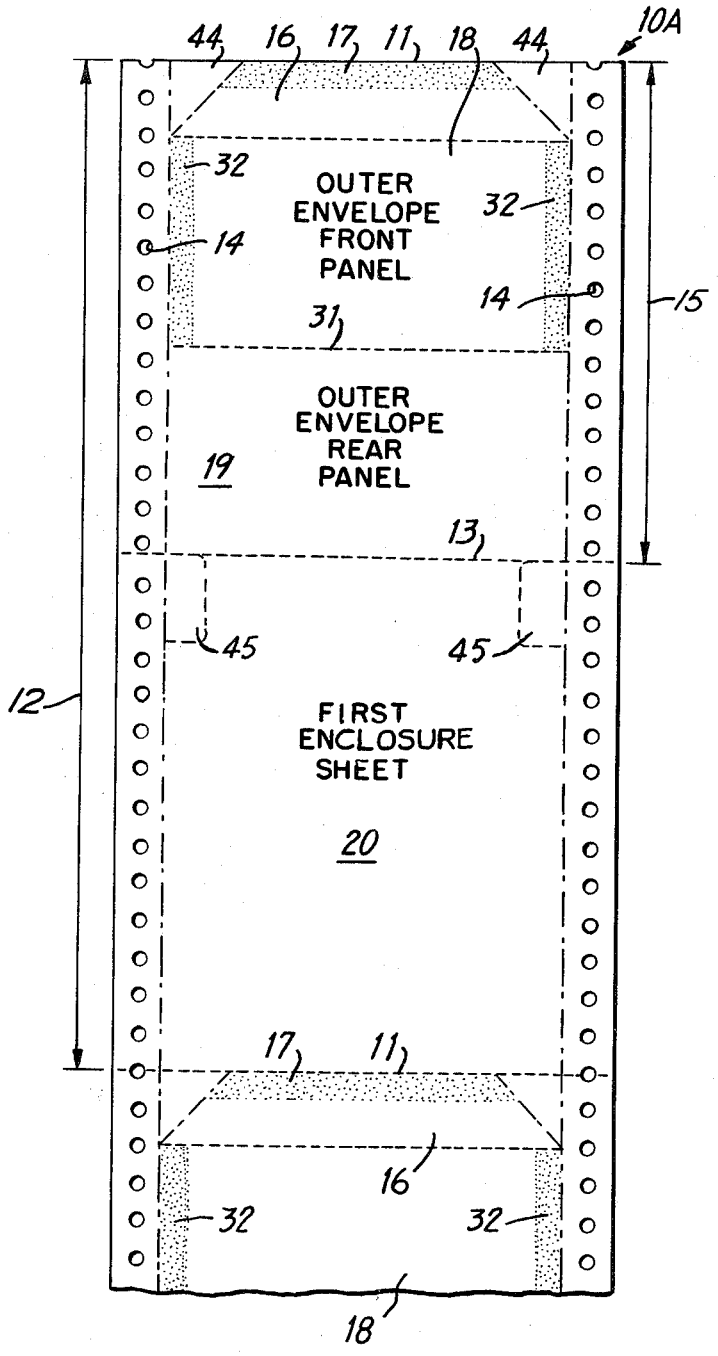
FIG. 1A is a plan view showing a section of continuous paper web containing an outer envelope and first enclosure sheet.

Referring to the drawings in detail wherein like reference characters designate corresponding parts throughout the several Figures, and particularly to FIG. 1A, there is shown web 10A which is divided by perforated transverse cutting lines 11 into repeating composite sheets 12.

Figure 1B:
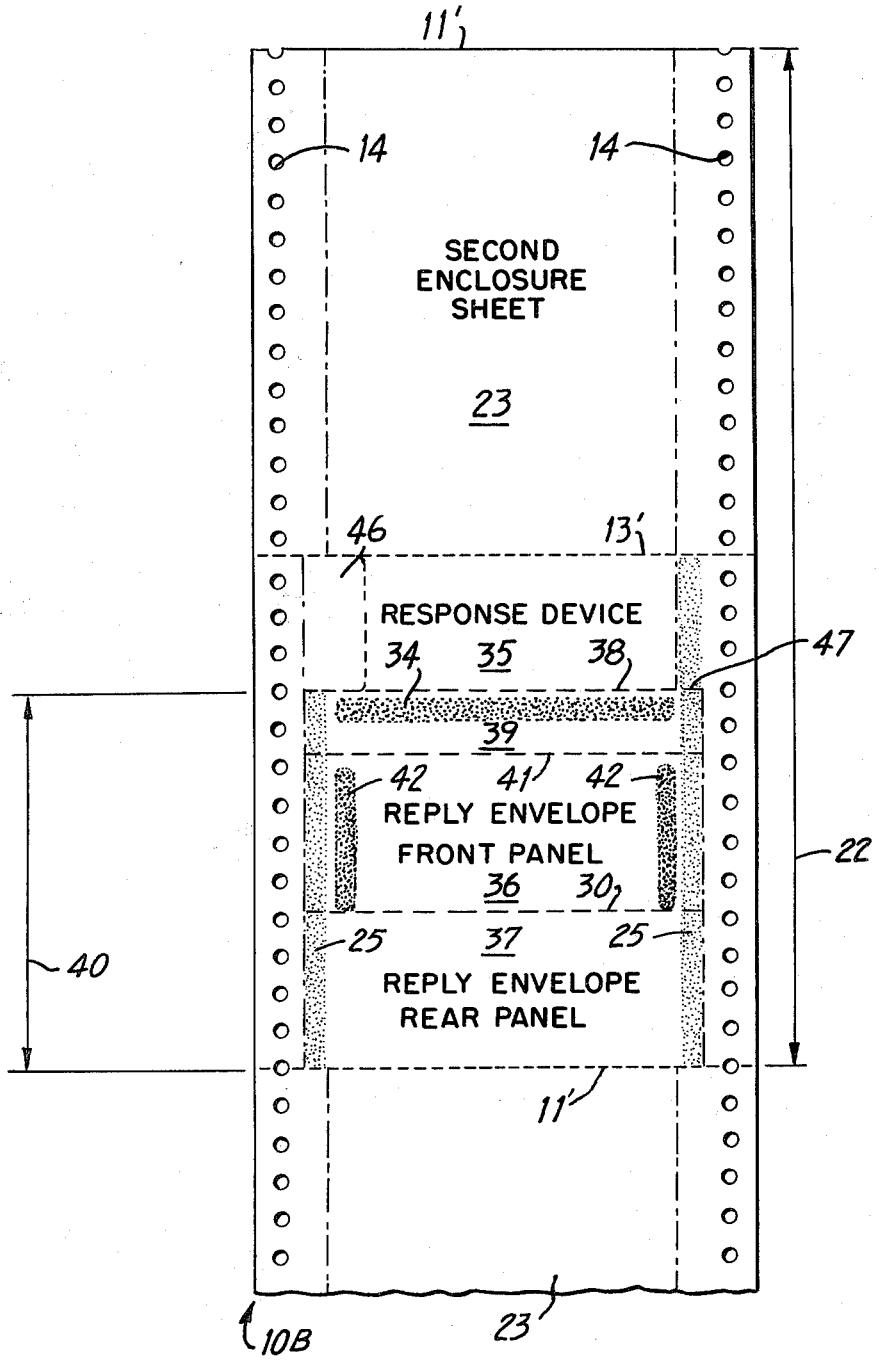
FIG. 1B is a plan view showing a section of continuous paper web containing a second enclosure sheet, response device and reply envelope sheet.

In FIG. 1B, there is shown web 10B which is likewise divided by perforated transverse cutting and folding lines 11' into repeating composite sheets 22.

Webs 10A and 10B are continuous web forms having line holes 14 that are engaged by a computer directed printer. This permits high speed feeding and proper indexing of the forms for insertion of the personalized messages, and facilitates the bursting operation described below. Webs 10A and 10B are also optionally provided with perforated folding lines 13 and 13', respectively, to facilitate fan folding.

As shown in FIG. 1A, the composite sheet 12 contains an outer envelope sheet 15 defining a flap 16, to which a remoistenable gum adhesive 17 can be applied. Composite sheet 13 also contains an outer envelope front panel 18, an outer envelope rear panel 19 and a first enclosure sheet 20. Outer envelope sheet 15 and enclosure sheet 20 are integral, being joined along transverse perforated folding line 13.

As shown in FIG. 1B, composite sheet 22 contains a second enclosure sheet 23, a response device 35 joined along transverse line 13' to second enclosure sheet 23, and a reply envelope sheet 40 joined along a transverse line of perforations 38 to response device 35. The reply envelope sheet 40 defines a reply envelope flap 39, a reply envelope front panel 36 and a reply envelope rear panel 37. Remoistenable gum adhesive 34 can be applied to flap 39.

Referring to the embodiments illustrated in FIGS. 1A and 1B, the distance between the longitudinal edges of reply envelope sheet 40 is equal to that of sheets 15 and 20. Envelope sheet 15 and second enclosure sheet 23 on respective webs 10A and 10B are the same length. Likewise, first enclosure sheet 20 is the same length as the aggregate length of reply envelope sheet 40 and response device 35. Thus, by properly indexing the preprinted webs 10A and 10B, as by use of the line holes 14, the composite sheets 12 and 22 can readily be aligned in a superposed configuration with response device 35 and reply envelope sheet 40 over first enclosure sheet 20, and second enclosure sheet 23 over outer envelope sheet 15. When sheets 12 and 22 are superposed in such a configuration, they can be thereafter moved as a unit.

In practicing this invention, blank web 10A is fed into a form printer, such as a flexigraphic, lithographic, gravure or letter press. Each of these presses can print, for example, a form letter appropriately positioned to correspond to the field of first enclosure sheet 20 on web 10A. In a similar fashion, web 10B is fed into a form printer which can print the fields of second enclosure sheet 23 and response device 35. This form printer also prints the reply mailing address on reply envelope front panel 36 and optionally a return postage mailing permit and any form message which the sender desires to have within the fields of reply envelope front panel 36 or rear panel 37. Both sides of sheets 20, 23 and response device 35 can be printed, if desired.

Referring to FIG. 1B, portion 46 can be die-cut and removed by the form printer. The transverse width of portion 46 determines the transverse width of response device 35.

Likewise, each portion 45, having substantially the configuration shown in FIG. 1A, can also be die-cut and removed by the form printer. Their removal lessens the chance of a subsequent trimming operation, described below, leaving unsightly notches in envelope rear panel 19. Triangular portions 44 can also be removed by the form printer to provide the desired tapering configuration to the envelope flap 16. The shoulder 47, between response device 35 and flap 39, can also be die-cut on the printer to facilitate subsequent bursting steps described below.

The continuous webs exiting from the form printers are next indexed and fed into computer directed printers for personalization. Conventionally, panel 18 of envelope sheet 15 will be printed with the name and address of the recipient. If first enclosure sheet 20 is in a letter format, the name and address can be entered and a personal salutation printed, along with any other desired personal data references in the body of the letter. Second enclosure sheet 23 may similarly be personalized, with further personal data references in the body of the letter. Response device 35 can also advantageously be personalized, as by printing the recipient's name and address to indicate acceptance of a solicitation contained on enclosure sheets 20 and 23. Finally, the recipient's reply address can be entered either on reply envelope front panel 36 or flap 39. It is also possible to include a unique customer or account number, or other personalized information.

After webs 10A and 10B exit the computer directed printers, beads or spots 25 of liquid adhesive or hot melt adhesive are applied just inside the opposite longitudinal edges of either enclosure sheet 20 or reply envelope sheet 40. The position of these beads or spots 25 are shown in FIG. 1B. Alternatively, beads or spots 25 can be applied to a more limited area of either sheets 20 or 40. For example, it is satisfactory to apply spots 25 only to the lower left portion of reply envelope rear panel 37.

After application of the adhesive, webs 10A and 10B are brought into an aligned superposed configuration for mating. They are then pressed together so that they are joined and bonded by means of the adhesive beads or spots 25. Alternatively, instead of using a separately applied adhesive, bonding can be accomplished by passing composite sheets 12 and 22 through crimping wheels or other crimping means which are known in the art.

Composite sheets 12 and 22 remain joined together during subsequent steps and through one of the folding operations. The joining of composite sheets 12 and 22 together entirely eliminates any risk of a subsequent mismatching and its attendant waste, and reduces greatly the need for quality control checks on the finished product. Furthermore, this method of joining composite sheets 12 and 22 substantially eliminates shifting and misalignment during the high speed folding process.

Mating and glued webs 10A and 10B are next subject to a line hole slitting and removal operation that occurs on a burster. Specifically, those portions of composite sheet 22 lying outside the field of envelope sheet 15 and first enclosure sheet 20 are removed. In a similar manner, those portions of composite sheet 22 which lie outside the fields of second enclosure sheet 23, response device 35 and reply envelope sheet 40 are removed.

Figure 2:
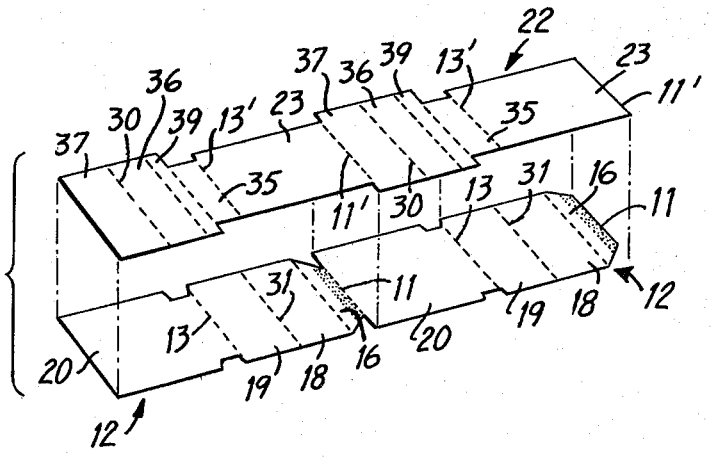
FIG. 2 is a side exploded perspective view illustrating the alignment for mating of two of the partially processed composite sheets from the continuous webs of FIGS. 1A and 1B.

Line hole slitting and removal preferably is accomplished by appropriately positioned slitting apparatus that makes the necessary longitudinal cuts. The longitudinal edge portions of webs 10A and 10B, which contain the line holes, are then removed. FIG. 2 illustrates, in an exploded perspective view, sections of webs 10A and 10B, comprising adjacent composite sheets following the line hole cutting and removal operation and prior to bursting.

The burster also separates, or "bursts," the mated sheets along transverse cutting lines 11 and 11'.

Figure 3:
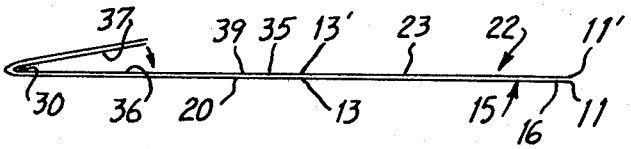
FIG. 3 is a schematic side view showing the first folding step partially completed on the aligned and joined integral outer envelope and first enclosure sheets and integral second enclosure sheet, response device and reply envelope sheet after die-cutting and bursting from the continuous paper web.
Figure 4:
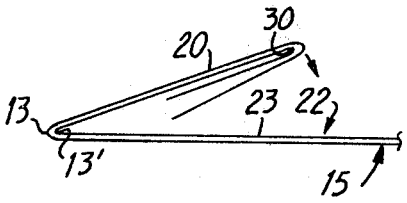
FIG. 4 is a schematic side view of the elements shown in FIG. 3, illustrating the partially completed second folding step.
Figure 5:
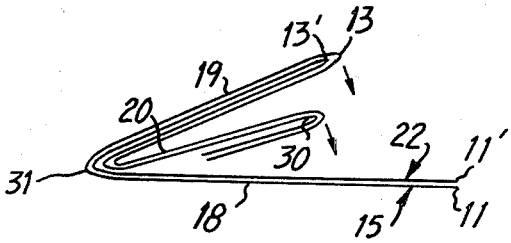
FIG. 5 is a schematic side view of the elements shown in FIG. 4, illustrating the partially complete third folding step.

Following bursting, the individual composite sheets 12 and 22, joined together by beads or spots 25, are fed into a conventional multiplate folding machine where three transverse folds are to be made. The sequence and direction of the folds are illustrated in FIGS. 3, 4 and 5.

Prior to making the first fold, a bead of adhesive 42 is applied inwardly of each opposite longitudinal edge of either reply envelope front panel 36 or rear panel 37. It is preferable to apply adhesive inwardly of the edges of reply envelope front panel 36, as shown in FIG. 1B.

After application of adhesive, reply envelope rear panel 37 is folded towards reply envelope front panel 36 along transverse fold line 30. This folding step is shown in FIG. 3. In the embodiment of FIG. 3, the position of fold line 30 is somewhat less than one third of the distance between, on the first part, the free ends of first enclosure sheet 20 and reply envelope rear panel 37, and, on the second part, perforated folding lines 13 and 13'. This fold line position is preferred since it prevents further folding in a subsequent folding step of the free ends of first enclosure sheet 20 and reply envelope rear panel 37, as illustrated in FIG. 5.

Present U.S. Postal Service regulations constrain to some degree the position of fold line 30, since an envelope must be a certain minimum size before it will be accepted for delivery. The distance between folding line 41 and folding line 30 should be selected in order to comply with such regulations. Subject to this constraint, suitable positions for folding line 30 will be apparent to one skilled in the art after reading the description of this specification.

Figure 6:
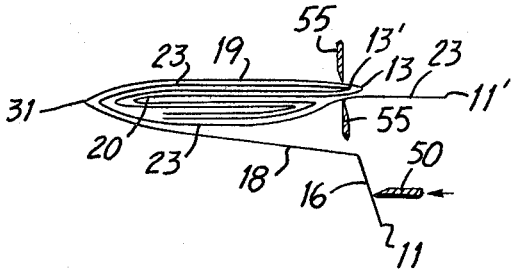
FIG. 6 is a cutaway, sectional schematic side view showing the steps of simultaneously separating and trimming the enclosures and the top edge of the rear envelope panel.
Figure 7A:
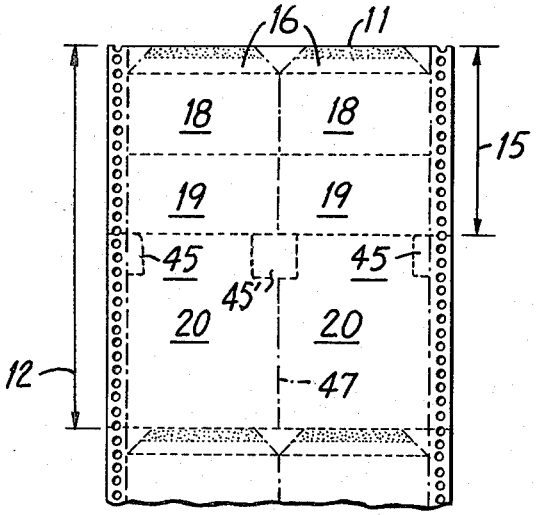
FIG. 7A is a plan view showing a section of continuous paper web containing two outer envelope and first enclosure sheets in parallel configuration.
Figure 7B:
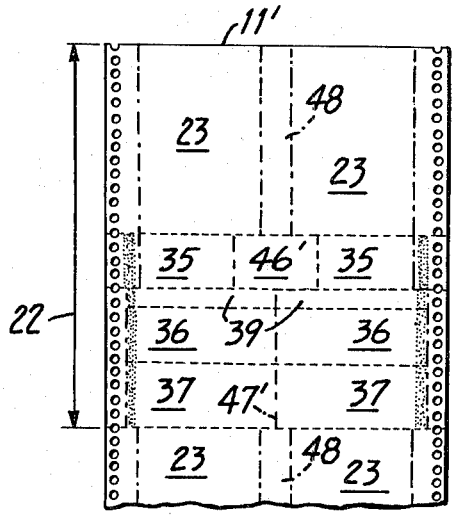
FIG. 7B is a plan view showing a section of continuous paper web containing, in parallel configuration, pairs of second enclosure sheets, response devices, and reply envelope sheets.
Figure 7C:
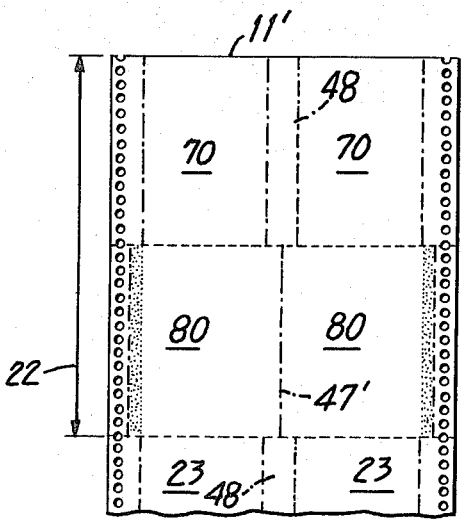
FIG. 7C is a plan view showing a section of continuous paper web containing a pair of additional enclosure sheets in parallel configuration.
Figure 7D:
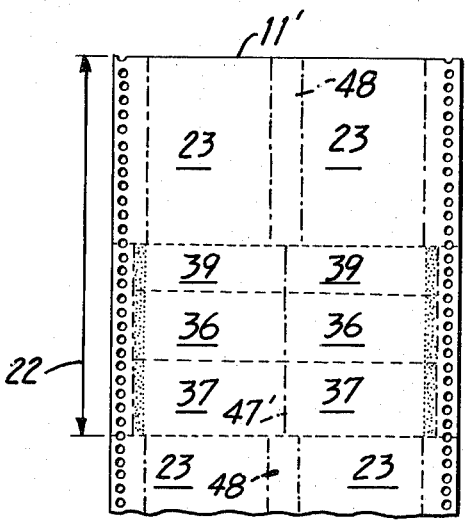
FIG. 7D is a plan view showing a section of continuous paper web containing, in parallel configuration, pairs of second enclosure sheets and reply envelope sheets.
Figure 7E:
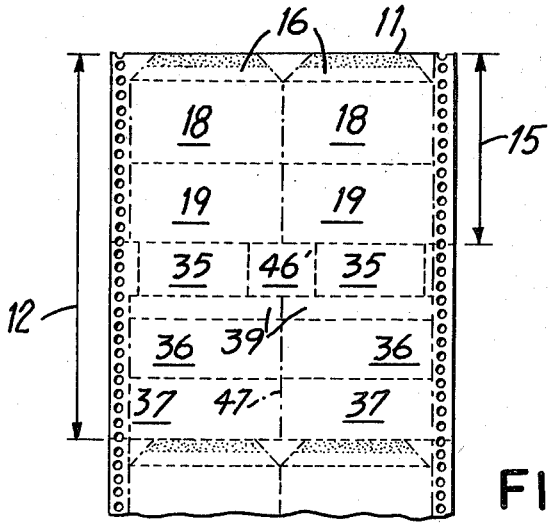
FIG. 7E is a plan view showing a section of continuous paper web containing, in parallel configuration, pairs of outer envelope sheets, response devices, and reply envelope sheets.

Upon folding, reply envelope rear panel 37 is superposed and brought into overlying alignment with reply envelope front panel 36. Pressure is then applied to seal the opposite edges to form a reply envelope pocket. For illustrative purposes only, FIGS. 4 through 6 show reply envelope front and rear panels 36 and 37 as separate panels, even though they are sealed to form a reply envelope pocket, so that the structure produced by the present method can be described with clarity.

As shown in FIG. 4, mated and joined composite sheets 12 and 22 are next folded along a second transverse fold line corresponding to perforated fold lines 13 and 13', respectively. As this second fold is made, the opposite longitudinal edges of first enclosure sheet 20, and the reply envelope pocket made from reply envelope front panel 36 and rear panel 37 are trimmed off, as by a cutting wheel. As a result of this trimming operation, the transverse width of the reply envelope pocket is approximately equal to that of second enclosure sheet 23. Since adhesive beads 42 were applied inwardly of the edges that were trimmed, the reply envelope pocket remains intact subsequent to trimming.

As will be understood with reference to the above description, the foregoing trimming operation completely removes those portions of the sheets that were glued together to hold the sheets in a mated aligned superposed configuration. However, no undesirable shifting or misalignment during subsequent processing results, because the two previous folds result in composite sheets 12 and 22 being in a folded and securely nested configuration.

As will be appreciated by one familiar with the apparatus employed in the art, the various steps described above can be combined or rearranged in order to accommodate the format of the composite sheets and the capabilities of the equipment available.

In the next step, beads of adhesive are applied along the opposite longitudinal edges of the inside of either outer envelope front or rear panel 18 or 19, and the panel edges are brought into overlying alignment and pressure is applied to seal the opposite edges to form the outer envelope pocket containing the various enclosures. It is preferred that the adhesive be applied to the opposite edges 32 of outer envelope front panel 18, as illustrated in FIG. 1A.

In the final step, the folded first enclosure sheet 20 is separated from the outer envelope rear panel 19 along line 13 and second enclosure sheet 23 is separated from response device 35 along line 13'. These separation operations can advantageously be combined into a single step with the final trimming of the exposed edges that appear behind the front panel of the envelope sheet. In this cutting step, any portion of second enclosure sheet 23 which overlaps flap 16 should be removed so that the finished envelope can be sealed. Thus a slitting device, comprising scissor slitting wheels, is adjusted to the thickness of the paper stock to trim cleanly away the following: both ends of second enclosure sheet 23; portions of first enclosure sheet 20 and outer envelope rear panel 19 lying adjacent to fold line 13; and the portion of response device 35 lying adjacent to fold line 13'. The paper to be trimmed is made accessible to the slitting device by means of a flap deflector 50, which temporarily bends down outer envelope flap 16. The edges of the above-identified materials can then be passed into slitting wheels 55. This step is illustrated in FIG. 6, which is a cutaway sectional view showing the enclosures and upper edge of rear envelope panel 19 being engaged by cutting wheels 55, while flap 16 is held out of the way by flap deflector 50.

As a result of the final separation or trimming, this particular embodiment of the method of this invention results in a personalized envelope containing two separate enclosure sheets in a nested configuration with a preformed reply envelope, to which is detachably connected a response device.

Figure 1C:
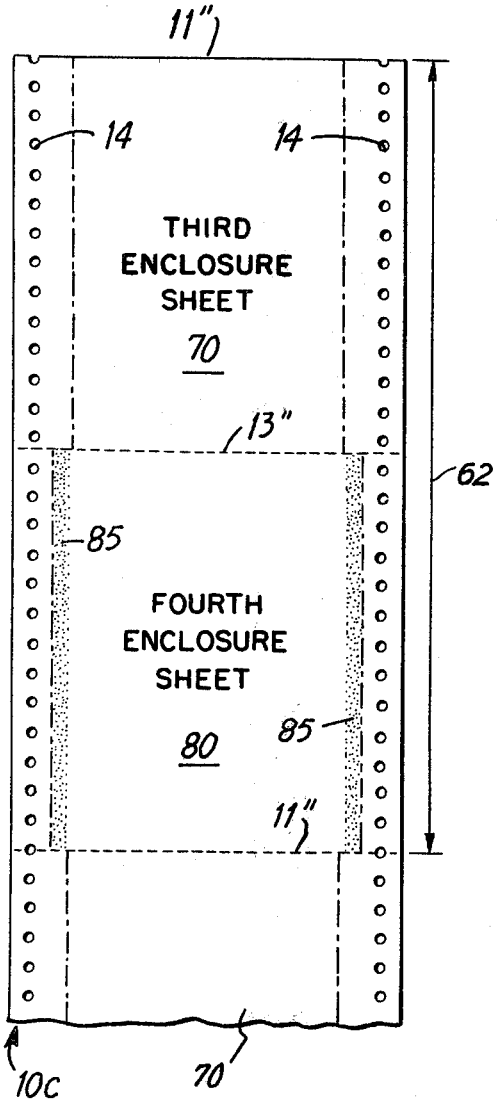
FIG. 1C is a plan view showing a section of continuous paper web containing additional enclosure sheets.

It is also possible to provide additional enclosure sheets. Referring to FIG. 1C, there is shown a third web 10C which is divided by perforated cutting lines 11" into repeating composite sheets 62. Composite sheet 62 contains a third enclosure sheet 70 and a fourth enclosure sheet 80. Perforated folding lines 13" are again preferably provided to facilitate fan folding.

As shown in FIG. 1C, the longitudinal edges of third enclosure sheet 70 are positioned inside the longitudinal edges of fourth enclosure sheet 80.

The distance between the longitudinal edges of fourth enclosure sheet 80 is equal to that of first enclosure sheet 20 and outer envelope rear panel 19. Thus, in a manner similar to that previously described for webs 10A and 10B, web 10C can be aligned in a superposed configuration between webs 10A and 10B so that response device 35 and reply envelope sheet 40 are over fourth enclosure sheet 80, which in turn is over first enclosure sheet 20, and second enclosure sheet 23 is over third enclosure sheet 70 which in turn is over envelope sheet 15. In such a superposed configuration, the three webs 10A, 10B, and 10C can be moved as a unit.

The method of fabrication described above for two webs is substantially identical to the method used for three webs. The only additional necessary step is the application of beads or spots of adhesive 85 to fourth enclosure sheet 80 at a position just inside of its opposite longitudinal edges prior to bringing the webs together in an aligned and mated configuration. After the webs are joined and bonded together, subsequent processing is identical to that employed with two webs only.

In a similar manner, use of additional webs 10C allows any number of enclosure sheets to be used.

Figure 1D:
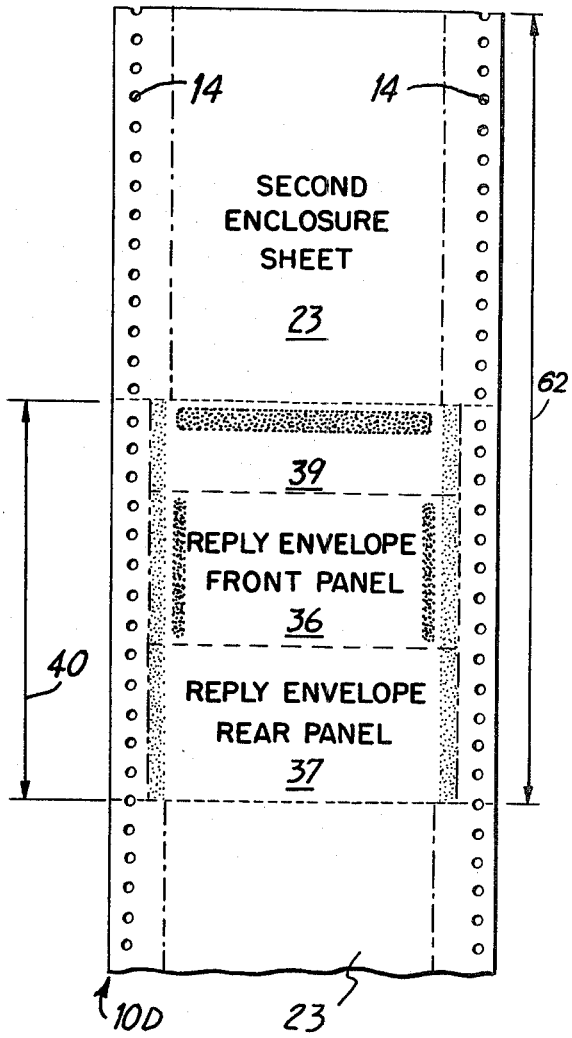
FIG. 1D is a plan view showing a section of continuous paper web containing a second enclosure sheet and reply envelope only.

In another embodiment of the present invention, it is possible to eliminate response device 35, as would be desirable where it would prove superfluous, as in the case where second enclosure sheet 23 is intended to be a form to be returned by the recipient in the reply envelope. FIG. 1D shows web 10D, wherein the longitudinal dimensions of flap 39, reply envelope front panel 36 and reply envelope rear panel 37 are increased so that response device 35 is eliminated. Web 10D can be used according to the methods described above. Web 10D can also be used in combination with web 10C to provide additional enclosure sheets as desired.

Figure 1E:
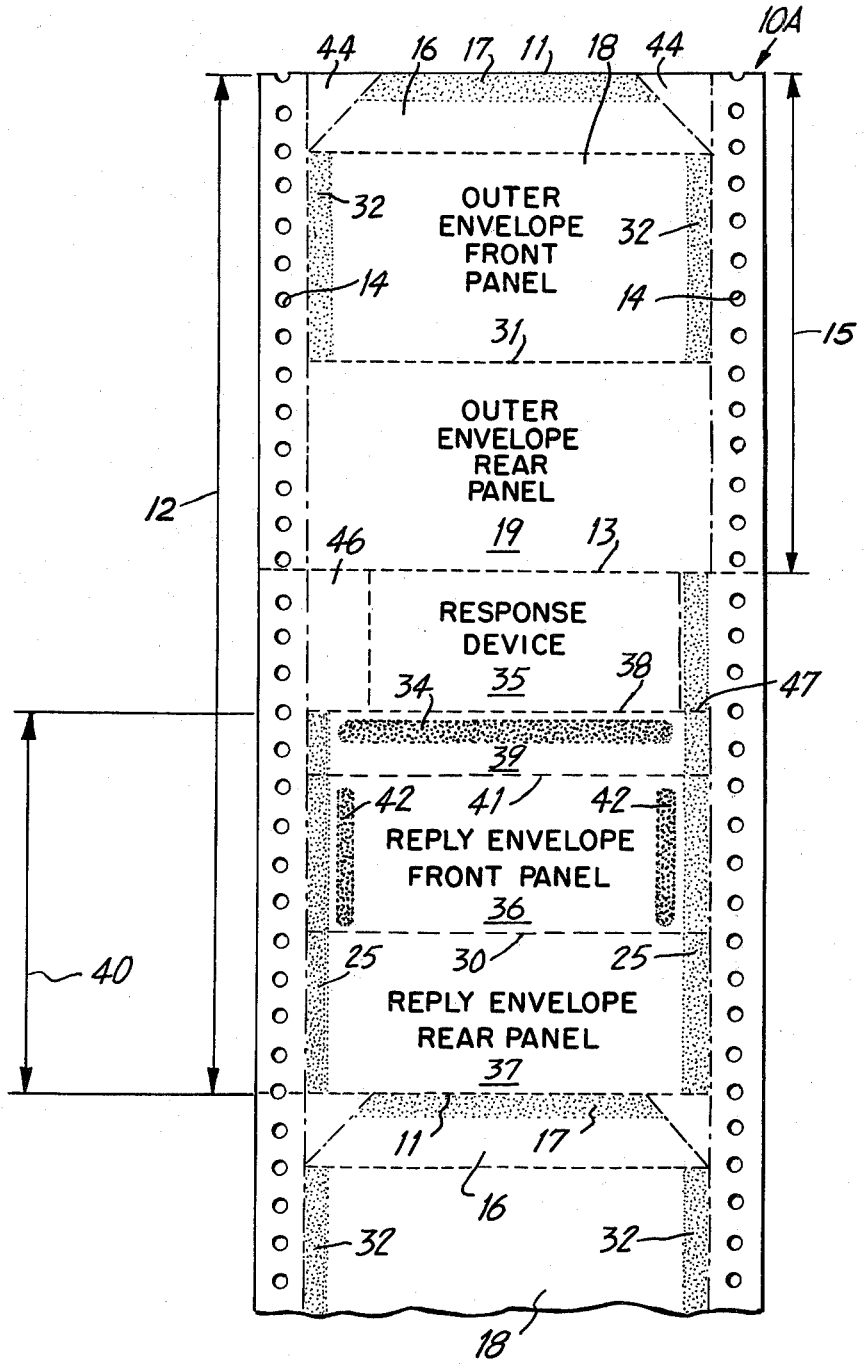
FIG. 1E is a plan view showing a section of continuous paper web containing an outer envelope sheet, a response device and a reply envelope sheet.

Yet another embodiment of the present invention is shown in FIG. 1E. As shown in this figure, response device 35 is joined along transverse line 13 to outer envelope rear panel 19, and reply envelope 40 is joined along transverse line of perforations 38 to response device 35. Hence, in the embodiment shown in FIG. 1E, composite sheet 12 comprises outer envelope panel 15, response device 35 and reply envelope panel 40. This embodiment results in a personalized outer envelope containing a response device detachably connected to a preformed reply envelope. It is useful where the response device satisfactorily serves to contain both the sender's message and the recipient's reply, such that other enclosures would prove unnecessary.

A second composite sheet, either as shown in FIGS. 1B and 1D, is not used with the embodiment shown in FIG. 1E. Nonetheless, the folding and gluing steps illustrated in and associated with FIGS. 3 through 5 are equally applicable to the embodiment of FIG. 1E.

The final trimming step illustrated in FIG. 6 is somewhat simplified using the embodiment of FIG. 1E, since the only paper to be trimmed are those portions of outer envelope panel 19 and response device 35 lying adjacent fold line 13.

Depending upon the capacity of the form and computer directed printing equipment, and the desired size and volume of the envelopes and enclosures to be produced, as well as other economic considerations which will be apparent to those familiar with this art, it may be preferred to use a plurality of composite sheets in parallel configuration. There is shown in FIGS. 7A, 7B, 7C, 7D and 7E typical parallel composite sheets, each of which comprises a line hole punch paper web containing in parallel configuration, pairs of sheets corresponding respectively to those shown in FIGS. 1A, 1B, 1C, 1D and 1E. In all other respects, the parts of FIG. 7 correspond to those of FIG. 1. In practicing the method of the invention with the typical webs illustrated in FIG. 7, it is necessary to perform the obvious die-cutting and bursting operations to separate the parallel forms where they are joined, along lines 47 and 47', as the case may be, and, where necessary, to remove paper strip 48 aligned between the parallel enclosure sheets. Portion 46' is generally removed during the form printing operation.

The specific embodiment described above is intended to be representative and illustrative of the method of the invention which can be modified without departing from the spirit and the scope of the invention which is to be described by the following claims.

We claim:

1. A method for producing an article suitable for mailing that consists of an outer envelope containing a plurality of enclosure sheets and a preformed reply envelope, the method comprising the steps of:

(a) mating in a superposed aligned configuration a first composite sheet consisting of:
  i. an outer envelope sheet defining a flap, a front panel and a rear panel, and integral therewith
  ii. a first enclosure sheet joined along a transverse line to said rear panel;
  and a second composite sheet consisting of:
  i. a second enclosure sheet, and integral therewith
  ii. a reply envelope sheet defining a flap, a front panel, and a rear panel, said reply envelope sheet joined along a transverse line to said second enclosure sheet;
(b) folding the composite sheets to superpose the reply envelope rear panel with the reply envelope front panel;
(c) bonding the longitudinal edges of the front and rear reply envelope panels to form a reply envelope pocket;
(d) further folding the composite sheets to position the reply envelope, first enclosure sheet and second enclosure sheet between the front and rear panels of the outer envelope sheet;
(e) bonding the longitudinal edges of the outer envelope front and rear panels to form an outer envelope pocket containing the reply envelope, first and second enclosure sheets; and
(f) while the outer envelope flap is open, simultaneously separating the reply envelope from the second enclosure sheet, and the first enclosure sheet from the outer envelope rear panel, to thereby provide an envelope containing separate first and second enclosure sheets, and a separate preformed reply envelope.

2. The method of claim 1, wherein a third composite sheet containing integral third and fourth enclosure sheets is mated in a superposed configuration between the first and second enclosure sheets.

3. The method of claim 2, wherein the further folding of step d comprises:

(1) folding the first, third and second composite sheets along a first transverse line, lying between the outer envelope rear panel and the first enclosure sheet, to position the first enclosure sheet, fourth enclosure sheet and reply envelope over the inside of the outer envelope front and rear panels; and
(2) folding said composite sheets along a second transverse line, lying between the outer envelope front and rear panels.

4. The method of claim 3, wherein the composite sheets are maintained in a superposed aligned configuration by bonding the opposite longitudinal edges of the composite sheets, and removing the bonded longitudinal edge segments prior to bonding the longitudinal edges of the front and rear envelope panels.

5. The method of claim 1, wherein the further folding of step d comprises:

(1) folding the first and second composite sheets along a first transverse line lying between the outer envelope rear panel and the first enclosure sheet, to position the first enclosure sheet and reply envelope over the inside of the outer envelope front and rear panels; and
(2) folding said composite sheets along a second transverse line, lying between the outer envelope front and rear panels.

6. The method of claim 3, wherein the separating of Step f is accomplished by trimming off a portion of the outer envelope rear panel and enclosures along a transverse line adjacent the first transverse folding line.

7. A method for producing an article suitable for mailing that consists of an outer envelope containing a plurality of enclosure sheets and a response device detachably connected to a preformed reply envelope, the method comprising the steps of:

(a) mating in a superposed aligned configuration a first composite sheet consisting of:
  i. an outer envelope sheet defining a flap, a front panel and a rear panel, and integral therewith
  ii. a first enclosure sheet joined along a transverse line to said rear panel;
  and a second composite sheet consisting of:
  i. a second enclosure sheet, and integral therewith
  ii. a response device joined along a transverse line to said second enclosure sheet, and integral therewith
  iii. a reply envelope sheet defining a flap, a front panel, and a rear panel, said reply envelope sheet joined along a transverse line of perforations to said response device;
(b) folding the composite sheets to superpose the reply envelope rear panel with the reply envelope front panel;
(c) bonding the longitudinal edges of the front and rear reply envelope panels to form a reply envelope pocket;

(d) further folding the composite sheets to position the reply envelope, response device, first enclosure sheet and second enclosure sheet between the front and rear panels of the outer envelope sheet;

(e) bonding the longitudinal edges of the outer envelope front and rear panels to form an outer envelope pocket containing the response device, reply envelope, first and second enclosure sheets; and (f) while the outer envelope flap is open, simultaneously separating the response device from the second enclosure sheet, and the first enclosure sheet from the outer envelope rear panel, to thereby provide an outer envelope containing separate first and second enclosure sheets, and a separate reply envelope, with a response device detachably connected thereto.

8. The method of claim 7, wherein the further folding of step d comprises:

(1) folding the first and second composite sheets along a first transverse line lying between the outer envelope rear panel and the first enclosure sheet, to position the first enclosure sheet, response device and reply envelope over the inside of the outer envelope front and rear panels; and (2) folding said composite sheets along a second transverse line, lying between the outer envelope front and rear panels.

9. The method of claim 5 or 8, wherein the composite sheets are maintained in a superposed aligned configuration by bonding the opposite longitudinal edges of the composite sheets, and removing the bonded longitudinal edge segments prior to bonding the longitudinal edges of the front and rear envelope panels.

10. The method of claim 5 or 8, wherein the separating of Step f is accomplished by trimming off a portion of the outer envelope rear panel and enclosures along a transverse line adjacent the first transverse folding line.

11. The method of claim 1 or 7, wherein the first and second composite sheets each form a part of separate continuous paper webs.

12. The method of claim 1 or 7, wherein the outer envelope and first enclosure sheet are personalized.

13. The method of claim 12, wherein the second composite sheet is also personalized.

14. A method for producing from a single composite sheet an article suitable for mailing that consists of an outer envelope containing a response device detachably connected to a preformed reply envelope, the composite sheet consisting of:

i. an outer envelope sheet defining a flap, a front panel and a rear panel, and integral therewith ii. a response device joined along a transverse line to said outer envelope rear panel, and integral therewith iii. a reply envelope sheet defining a reply envelope flap, a reply envelope front panel, and a reply envelope rear panel, said reply envelope sheet joined along a transverse line of perforations to said response device;

the method comprising the steps of:

(a) folding the composite sheet to superpose the reply envelope rear panel with the reply envelope front panel;

(b) bonding the longitudinal edges of the front and rear reply envelope panels to form a reply envelope pocket;

(c) further folding the composite sheet to position the reply envelope and response device between the front and rear panels of the outer envelope sheet;

(d) bonding the longitudinal edges of the outer envelope front and rear panels to form an outer envelope pocket containing the response device and the reply envelope; and (e) while the outer envelope flap is open, separating the response device from the outer envelope rear panel, to thereby provide an outer envelope containing a separate preformed reply envelope with a response device detachably connected thereto.

15. The method of claim 14, wherein the further folding of step c comprises:

(1) folding the composite sheet along a first transverse line, lying between the outer envelope rear panel and the response device, to position the response device and reply envelope over the inside of the outer envelope front and rear panels; and (2) folding said composite sheet along a second transverse line, lying between the outer envelope front and rear panels.

16. The method of claim 14, wherein the composite sheet forms a part of a continuous paper web.

17. The method of claim 14, wherein the outer envelope is personalized.

18. The method of claim 17, wherein the response device is also personalized.

19. The method of claim 15, wherein the separating of Step e is accomplished by trimming off a portion of the outer envelope rear panel and response device along a transverse line adjacent the first transverse folding line.

* * * * *